US007891177B2

(12) United States Patent
Ammineni et al.

(10) Patent No.: US 7,891,177 B2
(45) Date of Patent: Feb. 22, 2011

(54) PARTICULATE TRAP TEMPERATURE SENSOR SWAP DETECTION

(75) Inventors: Chandini M. Ammineni, Peoria, IL (US); Andrew J. Zich, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 764 days.

(21) Appl. No.: 11/980,466

(22) Filed: Oct. 31, 2007

(65) Prior Publication Data

US 2009/0107114 A1 Apr. 30, 2009

(51) Int. Cl.
*F01N 3/00* (2006.01)

(52) U.S. Cl. ..... 60/297; 73/114.69

(58) Field of Classification Search ..... 60/297; 73/114.69, 114.75

See application file for complete search history.

(56) References Cited

U.S. PATENT DOCUMENTS

| | | | | |
|---|---|---|---|---|
| 4,209,981 | A | 7/1980 | Miyamori et al. | |
| 5,369,957 | A * | 12/1994 | Hanson | 62/126 |
| 6,651,422 | B1 | 11/2003 | LeGare | |
| 6,898,585 | B2 | 5/2005 | Benson et al. | |
| 7,043,351 | B2 | 5/2006 | Grossman et al. | |
| 7,159,391 | B2 | 1/2007 | Kogo et al. | |
| 7,178,326 | B2 | 2/2007 | Kojima et al. | |
| 7,179,316 | B2 | 2/2007 | Merkel et al. | |
| 7,203,588 | B2 | 4/2007 | Kaneko et al. | |
| 7,216,481 | B2 | 5/2007 | MacBain et al. | |
| 7,243,488 | B2 | 7/2007 | Bonadies et al. | |
| 7,243,489 | B2 | 7/2007 | Johnson et al. | |
| 7,259,120 | B2 | 8/2007 | Ellison et al. | |
| 2004/0261402 | A1 | 12/2004 | Sealy et al. | |
| 2005/0241301 | A1 | 11/2005 | Okugawa et al. | |
| 2006/0032213 | A1 | 2/2006 | Woll et al. | |
| 2006/0179826 | A1 | 8/2006 | Kuboshima et al. | |
| 2006/0242945 | A1 | 11/2006 | Wang et al. | |
| 2006/0242950 | A1 | 11/2006 | Wang et al. | |
| 2007/0033925 | A1 | 2/2007 | Berger et al. | |
| 2008/0083271 | A1 * | 4/2008 | He et al. | 73/118.1 |

FOREIGN PATENT DOCUMENTS

KR 2005112707 A * 12/2005

* cited by examiner

*Primary Examiner*—Thomas E Denion
*Assistant Examiner*—Jason Shanske
(74) *Attorney, Agent, or Firm*—Finnegan, Henderson, Farabow, Garrett & Dunner LLP

(57) ABSTRACT

An exhaust after-treatment system is disclosed. The system has a particulate trap disposed to remove particulate matter from an exhaust flow of an engine, an upstream temperature sensor disposed to measure a temperature of the exhaust flow upstream of the particulate trap, and a downstream temperature sensor disposed to measure a temperature of the exhaust flow downstream of the particulate trap. The system also has a controller in communication to receive from the upstream and downstream temperature sensors indications of the upstream and downstream temperatures. The controller is configured to compare the upstream and downstream temperatures, determine if the upstream and downstream temperature sensors are improperly swapped based on the comparison, and take a precaution if it is determined that the upstream and downstream temperature sensors are improperly swapped.

20 Claims, 3 Drawing Sheets

PARTICULATE TRAP TEMPERATURE SENSOR SWAP DETECTION

TECHNICAL FIELD

The present disclosure is directed to an exhaust after-treatment system, and, more particularly, to an exhaust after-treatment including particulate trap temperature sensor swap detection.

BACKGROUND

Engines, including diesel engines, gasoline engines, gaseous fuel powered engines, and other engines known in the art exhaust a complex mixture of air pollutants. These air pollutants include solid material known as particulate matter or soot. Due to increased attention on the environment, exhaust emission standards have become more stringent, and the amount of particulate matter emitted from an engine is regulated depending on the type of engine, size of engine, and/or class of engine.

One method implemented by engine manufacturers to comply with the regulation of particulate matter exhausted to the environment has been to remove the particulate matter from the exhaust flow of an engine with a device called a particulate trap. A particulate trap is a filter designed to trap particulate matter and typically consists of a wire mesh or ceramic honeycomb medium. However, the use of the particulate trap for extended periods of time may cause the particulate matter to build up in the medium, thereby reducing the functionality of the filter and subsequent engine performance.

The collected particulate matter may be removed from the filter through a process called regeneration. To initiate regeneration of the filter, the temperature of the particulate matter entrained within the filter must be elevated to a combustion threshold at which the particulate matter is burned away. One way to elevate the temperature of the particulate matter is to inject a catalyst such as diesel fuel into the exhaust flow of the engine and ignite the injected fuel. Another way is to use a heating element or a flame-producing burner to heat the filter to the combustion threshold.

One method of controlling regeneration is described in U.S. Patent Application Publication No. 2005/0241301 by Okugawa et al. published on Nov. 3, 2005 (the "301 publication"). The 301 publication discloses a system to control regeneration of a diesel particulate trap (DPF) within an exhaust flow path. The system includes a temperature sensor upstream of the DPF, a temperature sensor downstream of the DPF, and a DPF differential pressure sensor in communication with a controller. As particulate matter accumulates in the DPF, the upstream-downstream pressure difference increases. The controller estimates the amount of accumulation based on the pressure difference and determines a target temperature necessary for regeneration of the DPF based on the amount of accumulation. During subsequent DPF regeneration, the controller operates an upstream oxidation catalyst to heat the DPF to the target temperature and thereby combust all of the accumulated particulate matter.

Although the system of the '301 publication may heat the DPF to an appropriate target combustion temperature, it may malfunction under some circumstances. Specifically, the system uses the upstream temperature sensor to determine the temperature of the DPF during regeneration. Thus, if the upstream temperature sensor and the downstream temperature sensor are installed in the wrong positions (i.e., swapped) due to improper manufacture or assembly, the system may improperly control regeneration. For example, the system may heat the DPF to a temperature far beyond the target and/or for a longer period of time than necessary, causing damage thereto or failure thereof.

This disclosure is directed to overcoming one or more of the problems set forth above.

SUMMARY

One aspect of the disclosure is directed to an exhaust after-treatment system. The system may include a particulate trap disposed to remove particulate matter from an exhaust flow of an engine, an upstream temperature sensor disposed to measure a temperature of the exhaust flow upstream of the particulate trap and a downstream temperature sensor disposed to measure a temperature of the exhaust flow downstream of the particulate trap. The system may further include a controller in communication to receive from the upstream and downstream temperature sensors indications of the upstream and downstream temperatures. The controller may be configured to compare the upstream and downstream temperatures, determine if the upstream and downstream temperature sensors are improperly swapped based on the comparison, and take a precaution if it is determined that the upstream and downstream temperature sensors are improperly swapped.

Another aspect of the disclosure is directed to a method. The method may include disposing a particulate trap to remove particulate matter from an exhaust flow of an engine, receiving from an upstream temperature sensor an indication of a temperature of the exhaust flow upstream of the particulate trap, and receiving from a downstream temperature sensor an indication of a temperature of the exhaust flow downstream of the particulate trap. The method may further include comparing the upstream and downstream temperatures, determining if the upstream and downstream temperature sensors are improperly swapped based on the comparison, and taking a precaution if it is determined that the upstream and downstream temperature sensors are improperly swapped.

DETAILED DESCRIPTION

Figure 1:
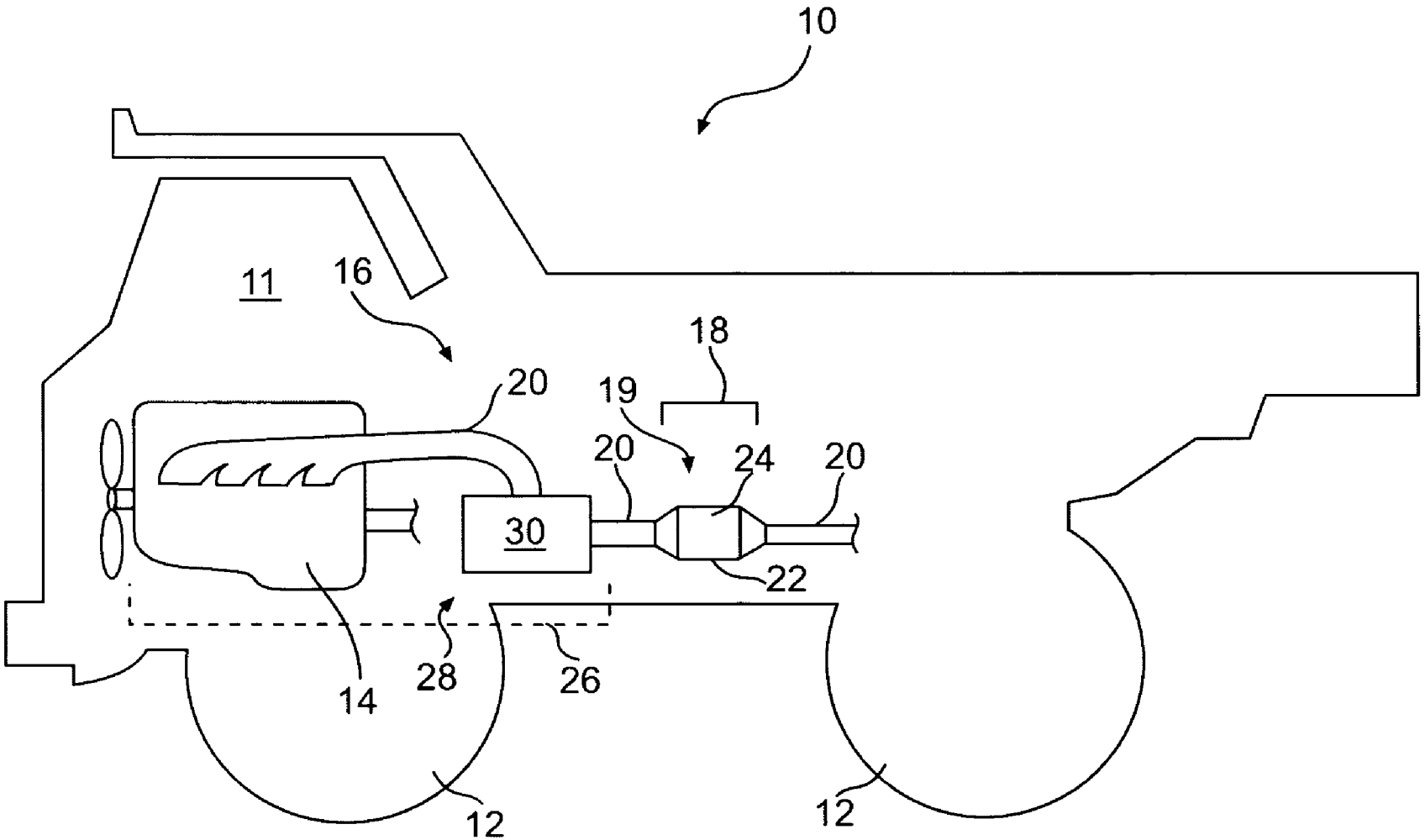
FIG. 1 is a diagrammatic illustration of a machine according to an exemplary disclosed embodiment.

FIG. 1 illustrates a machine 10. Machine 10 may include an operator station 11, one or more traction devices 12, an engine 14, and a particulate trap regeneration temperature control system 16. Although machine 10 is shown as a truck, machine 10 could be any type of machine having an exhaust-producing engine. Accordingly, traction devices 12 may be any type of traction devices, such as, for example, wheels, tracks, belts, or any combinations thereof.

Engine 14 may be any kind of engine that produces an exhaust flow of exhaust gases. For example, engine 14 may be an internal combustion engine, such as a gasoline engine, a diesel engine, a natural gas engine or any other exhaust gas producing engine.

System 16 may include an after-treatment device 18. After-treatment device 18 may be any type of device configured to remove one or more constituents from the exhaust flow of engine 14. In some embodiments, after-treatment device 18 may be regenerated by heat or another measure. In one embodiment, after-treatment device 18 may include a particulate trap 19. Particulate trap 19 may be configured to remove one or more types of particulate matter from the exhaust gases produced by engine 14 and flowing through an exhaust conduit 20 configured to direct all or a portion of the exhaust gases produced by engine 14 to after-treatment device 18. Particulate trap 19 may include an outer housing 22, which may encase a filter medium 24 (e.g. a metal mesh or screen, or a porous ceramic material, such as cordierite) configured to remove (i.e., trap) one or more types of particulate matter from the exhaust flow of engine 14.

Although after-treatment device 18 is discussed herein primarily as being a particulate trap, in other embodiments after-treatment device 18 may include multifunctional devices such as a combination of a catalytic converter and a particulate trap in the same unit or a catalytic particulate trap, wherein filter medium 24 may include a catalytic material and/or a catalytic coating.

After-treatment device 18 may be configured to be thermally regenerated. System 16 may include a heating system 26, which may be configured to increase the temperature of after-treatment device 18 (i.e., particulate trap 19). This may be done using a variety of different means and/or methods. For example, heating system 26 may be configured to apply heat directly to after-treatment device 18 via a heating device integrated with or adjacent to after-treatment device 18. An example of such a heating device may include an electric heating element (not shown).

Alternatively or additionally, heating system 26 may be configured to increase the temperature of after-treatment device 18 by transferring heat to after-treatment device 18 from the exhaust gases flowing through it. In such embodiments, heating system 26 may be configured to apply heat to exhaust gases upstream from after-treatment device 18. Heating system 26 may increase the temperature of exhaust gases in one or more ways. For example, altering engine parameters may have an effect on exhaust gas temperature. Running engine 14 with a "rich" air/fuel mixture may increase exhaust gas temperature. Increases in engine speed and/or load may also increase exhaust gas temperature. Timing and exhaust valve actuation may also be manipulated to control exhaust gas temperatures. Exhaust gases may also be heated by post injection, which involves injecting additional fuel into the combustion chambers after the combustion has taken place, which may result in the additional fuel being burned in the exhaust system, thereby elevating the temperature of the exhaust gases in the system.

Exhaust temperature may also be raised by heating the exhaust gases or exhaust conduit 20. For example, heating system 26 may include one or more heating devices, such as an electric heating element and/or a flame-producing burner configured to heat the exhaust gases or exhaust conduit 20. In one embodiment shown in FIG. 2, heating system 26 may include a regeneration device 28 configured to reduce an amount of particulate matter in after-treatment device 18. In an exemplary embodiment, regeneration device 28 may include a burner assembly 30 configured to increase the temperature of the exhaust gases flowing through exhaust conduit 20 upstream from after-treatment device 18.

Burner assembly 30 may maintain or restore the performance of after-treatment device 18 through thermal regeneration. Accumulation of exhaust flow constituents in after-treatment device 18 may result in a decline in engine performance and/or possible damage to after-treatment device 18 and/or other components of system 16. Burner assembly 30 may thus be configured to prevent or restore any decline in engine performance and avoid possible damage to after-treatment device 18 and/or other components of system 16. For example, burner assembly 30 may combust (i.e., burn off) at least some of the particulate matter that may have accumulated in after-treatment device 18 by raising the temperature of after-treatment device 18 to an appropriate combustion temperature.

Although system 16 is shown with a single after-treatment device 18 and a single regeneration device 28, system 16 may include more than one after-treatment device 18 and/or more than one regeneration device 28. For example, in one embodiment, system 16 may include a single regeneration device 28 configured to regenerate two after-treatment devices. In another embodiment, system 16 may include two regeneration devices configured to regenerate two after-treatment devices. In such an embodiment, each regeneration device may be configured to regenerate one of the after-treatment devices or contribute to the regeneration of both of the after-treatment devices. System 16 could also include any number of regeneration devices and/or after-treatment devices in any combination suitable for regeneration.

Figure 2:
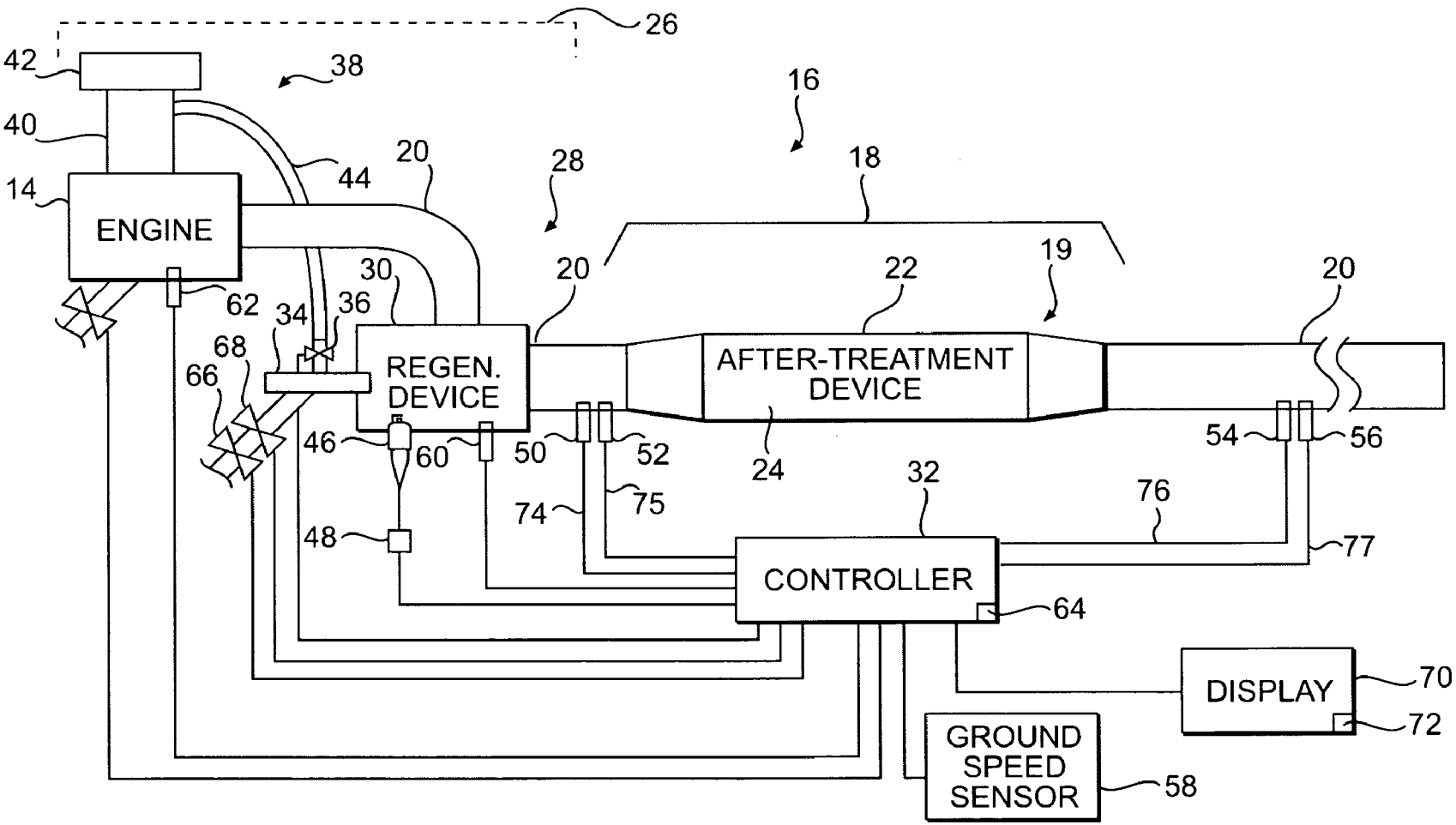
FIG. 2 is a diagrammatic illustration of a particulate trap regeneration control system according to an exemplary disclosed embodiment.

FIG. 2 illustrates an exemplary embodiment of particulate trap regeneration temperature control system 16. For purposes of the following explanation, after-treatment device 18 will be discussed as being particulate trap 19, while regeneration device 28 will be discussed as being burner assembly 30. However, it should be noted that after-treatment device 18 and regeneration device 28 could be any of the disclosed types of after-treatment and regeneration devices mentioned above. System 16 may also include a controller 32 configured to receive information from various sources and control one or more components of system 16 based on this information.

Burner assembly 30 may be positioned anywhere along exhaust conduit 20 between engine 14 and particulate trap 19 (i.e., upstream of particulate trap 19). Burner assembly 30 may include a fuel injector 34 configured to supply fuel to burner assembly 30. Burner assembly 30 may be configured to create a flame, which may be in a heat exchange relationship with the exhaust flow. System 16 may be configured to supply fuel injector 34 with fresh air for mixing with the fuel for combustion, as well as for flushing fuel injector 34 of any fuel or debris before and/or after operation of burner assembly 30. The supply of air to fuel injector 34 may be regulated by an air valve 36, controllable by controller 32.

In some embodiments, the source of the fresh air may be an air intake system 38 of engine 14. That is, air may be routed from a portion of air intake system 38, such as an intake manifold 40, downstream from a compressor 42 configured to create forced induction for engine 14. Compressor 42 may include a turbocharger, supercharger, or any other device configured to compress intake air and thereby produce forced induction for engine 14. Air may be directed from intake manifold 40 to fuel injector 34 via an air conduit 44. The supply of air to fuel injector 34 may be regulated by air valve 36, which may be controllable by controller 32 as discussed above.

Burner assembly 30 may also include a spark plug 46 configured to provide spark to ignite the air/fuel mixture delivered by fuel injector 34. Current may be supplied to spark plug 46 by an ignition coil 48, which may be controlled by controller 32. Although burner assembly 30 has been shown and described as including spark plug 46, alternative ignition sources may be employed, such as, for example, glow plugs or another means for igniting an air/fuel mixture.

Controller 32 may include any means for receiving machine operating parameter-related information and/or for monitoring, recording, storing, indexing, processing, and/or communicating such information. These means may include components such as, for example, a memory, one or more data storage devices, a central processing unit, or any other components that may be used to run an application. Although aspects of the present disclosure may be described generally as being stored in memory, one skilled in the art will appreciate that these aspects can be stored on or read from types of computer program products or computer-readable media, such as computer chips and secondary storage devices, including hard disks, floppy disks, optical media, CD-ROM, or other forms of RAM or ROM. Various other known circuits may be associated with controller 32, such as power supply circuitry, signal-conditioning circuitry, solenoid driver circuitry, communication circuitry, and other appropriate circuitry.

Controller 32 may perform multiple processing and controlling functions, such as, for example, engine management, determining particulate loading, and controlling regeneration of particulate trap 19. For instance, controller 32 may be an engine control module (ECM). Alternatively, machine 10 may include multiple controllers (a configuration not shown), each dedicated to perform one or more of these or other functions. Such multiple controllers may be configured to communicate and cooperate with one another.

Controller 32 may be further configured to activate regeneration device 28 in response to a determination that more than a predetermined amount of particulate matter is or may be trapped in filter medium 24. Controller 32 may also be configured to activate regeneration device 28 in response to one or more other trigger conditions. These other trigger conditions may include, for example, operation of engine 14 for a predetermined amount of time; consumption of a predetermined amount of fuel by engine 14; detection of an elevated backpressure upstream of particulate trap 19 above a predetermined pressure; detection of a pressure differential across particulate trap 19 greater than a predetermined amount; and/or a determination that a calculated or measured amount of particulate matter accumulated in particulate trap 19 is above a predetermined amount. Controller 32 may be configured to control regeneration to raise the temperature of particulate trap 19, i.e., the temperature of the exhaust flow upstream thereof, to a target combustion temperature at which the accumulated particulate matter may be burned off.

Regeneration may also be initiated manually by an operator, owner, service technician, etc. of machine 10. Manually triggering regeneration may be accomplished via a switch, button, or the like associated with machine 10 and/or a service tool configured to interface with machine 10.

System 16 may include various sensors configured to gather information about operating parameters of system 16. Such information may be communicated to controller 32 for subsequent determinations. For example, system 16 may include an upstream temperature sensor 50, an upstream pressure sensor 52, a downstream temperature sensor 54, and a downstream pressure sensor 56. Such sensors may be positioned along exhaust conduit 20 upstream and downstream from particulate trap 19, respectively, and configured to take measurements of the temperature and pressure of the exhaust gases within exhaust conduit 20 at their respective locations. These measurements may be communicated to controller 32. Specifically, each of sensors 50-54 may measure its respective temperature or pressure and generate a signal indicative of the measured temperature or pressure. The signals may be communicated to controller 32 via communication lines 74-77, respectively.

Upstream pressure sensor 52 and downstream pressure sensor 56 may constitute a pressure differential measurement system. Such a system may be configured to measure a pressure differential between an upstream pressure of the exhaust flow upstream from particulate trap 19 and a downstream pressure of the exhaust flow downstream from particulate trap 19. Alternatively, instead of upstream pressure sensor 52 and downstream pressure sensor 56, the pressure differential measurement system may include a single pressure differential sensor (not shown) configured to measure the difference in pressure between the exhaust flow upstream and downstream of particulate trap 19.

System 16 may also include a ground speed sensor 58 configured to monitor the ground speed of machine 10 (i.e., the speed of machine 10 relative to the surface over which it travels). System 16 may also be provided with a flame sensing system associated burner assembly 30 and configured to detect whether burner assembly 30 is currently producing a flame. Such a flame sensing system may include, for example, a flame sensor 60. In addition, system 16 may include an engine speed sensor 62 configured to measure the speed at which engine 14 is operating (i.e., rpm).

The aforementioned sensors may include any type of sensing means suitable for monitoring their respective parameters. In particular, flame sensor 60 may include any type of sensor suitable for detecting the presence of a flame, such as temperature sensors (e.g., thermocouples), optical sensors, ultraviolet sensors, and ion sensors. Flame sensor 60 may be configured to detect a condition (e.g., temperature, ultraviolet light, ions, etc.) in proximity to the flame. Such a condition may be monitored at any location within close enough proximity to the flame to enable the presence of the flame to be detected. Additionally or alternatively, the flame sensing system may be configured to detect a rate of change in the condition. For example, a temperature in proximity to the flame location that is increasing at a predetermined rate may indicate that a flame is lit and causing the increase.

In addition or as an alternative to flame sensor 60, upstream temperature sensor 50 may be located upstream of burner assembly 30. In such an embodiment, the flame sensing system may be configured to determine whether the downstream exhaust temperature measured by downstream temperature sensor 54 exceeds the upstream exhaust temperature measured by upstream temperature sensor 50 by a predetermined amount. A significantly higher downstream temperature may indicate that the flame is lit and is thus heating exhaust gases as they flow through burner assembly 30.

Controller 32 may include a timing device 64. Controller 32 may be configured to couple information from timing device 64 with information from other sources. For example, controller 32 may utilize information from timing device 64 in conjunction with information regarding operation of engine 14 (e.g., from engine speed sensor 62) to determine how long engine 14 is operated. Timing device 64 may also be used to monitor and control duration of regeneration events or any other operating parameters of system 16 and/or machine 10.

System 16 may be configured to control one or more additional system functions and/or parameters. Controller 32 may be configured to control the pressure of the fuel delivered to fuel injector 34 (and therefore the rate of fuel injection). A fuel on/off valve 66, which may be controllable by controller 32, may be associated with fuel injector 34 to selectively allow fuel to be delivered to fuel injector 34. In addition to fuel on/off valve 66, system 16 may also include a fuel pressure regulator valve 68 controllable by controller 32 to regulate the pressure of the fuel, and thereby the rate at which fuel is delivered to fuel injector 34. In some embodiments, controller 32 may be configured to control the pressure of fuel delivered to fuel injector 34 in a closed loop fashion, i.e., in response to pressure measurements taken at or near fuel injector 34 (e.g., by a fuel pressure sensor, not shown).

Controller 32 may be further configured to control fuel on/off valve 66 and/or fuel pressure regulator valve 68 (i.e., flow of fuel to fuel injector 34) in response to other parameters of system 16. For example, controller 32 may be configured to control the temperature of exhaust gases entering particulate trap 19 in response to feedback from upstream temperature sensor 50. This upstream exhaust temperature may be controlled by regulating the amount of fuel and/or air supplied to fuel injector 34, which may be accomplished by controlling fuel on/off valve 66 and/or fuel pressure regulator valve 68. Other types of regeneration devices or methods may be controlled in response to measurements taken by upstream temperature sensor 50. For example, the amount of post injection may be varied by controller 32 to regulate the temperature of the exhaust gases entering after-treatment device 18.

System 16 may include multiple fuel pressure regulator valves, which may be independently controlled. At least one fuel pressure regulator valve 68 may be configured to regulate main fuel pressure, and a second fuel pressure regulator valve (not shown) may be configured to regulate pilot fuel pressure. Pilot fuel pressure may be used during a pilot mode in which system 16 utilizes a predetermined air/fuel mixture to prevent flameouts during various engine operating conditions, e.g., hard accelerations and rapid decelerations.

Other operating parameters of system 16 may be monitored to maintain and/or optimize control of the regeneration process. For example, downstream temperature sensor 54 may detect whether downstream exhaust temperature is above a predetermined temperature. If the downstream exhaust temperature gets too high, it could indicate that temperatures within particulate trap 19 may be at an undesirably high level as well and/or that the regeneration may be somewhat unstable (e.g., incineration of particulate matter and/or a catalyst driven reaction may be intensifying within after-treatment device 18 beyond a level commanded by controller 32).

System 16 may also be configured to monitor the stability of the regeneration process by determining a difference between the upstream exhaust temperature measured by upstream temperature sensor 50 and the downstream exhaust temperature measured by downstream temperature sensor 54. If the downstream temperature exceeds the upstream temperature by more than a predetermined amount for more than a predetermined amount of time, for example, controller 32 may initiate steps to scale back or terminate the regeneration process. For example, in such a case, controller 32 may reduce the intensity of the flame produced by burner assembly 30. In some circumstances, controller 32 may terminate the regeneration process if the regeneration process is significantly unstable. For example, if the downstream temperature exceeds a predetermined value or exceeds the upstream exhaust temperature by more than a predetermined amount, then controller 32 may terminate the regeneration process.

Under some circumstances, upstream temperature sensor 50 and downstream temperature sensor 54 may be swapped due to improper installation. For instance, upstream temperature sensor 50 may be installed in the downstream temperature sensor's position, and vice versa; the wiring harness connecting the sensor box (not shown) to temperature sensors 50, 54 may be incorrect; and/or the internal wiring of the sensor box may be incorrect. As a result, controller 32 may attempt to control the regeneration process based on the wrong temperature indications. This improper control may result in excessive or insufficient regeneration events; increased thermal stress on and failure of after-treatment device 18; increased soot loot load on and failure of after-treatment device 18; decreased fuel efficiency, and/or increased harmful emissions.

Controller 32 may implement one or more strategies to detect swapped temperature sensors 50, 54. It is to be appreciated that, during normal operation of engine 14, upstream temperature sensor 50 may measure a higher temperature than downstream temperature sensor 54, because upstream temperature sensor 50 is closer to the combustion source. In addition, after-treatment device 18 may slightly insulate downstream temperature sensor 54 from the combustion source. In one aspect, controller 32 may determine that upstream temperature sensor 50 and downstream temperature sensor 54 are swapped if the measured downstream temperature is greater than the measured upstream temperature. In some applications, however, it may be difficult to detect swapped temperature sensors 50, 54 using this strategy because the upstream temperature and the downstream temperature may be about equal. As such, fluctuations caused by environmental factors and the imprecision or insensitivity of temperature sensors 50, 54 may render difficult detection in this manner of whether temperature sensors 50, 54 are swapped.

Controller 32 may also utilize the thermal inertia of after-treatment device 18 to detect whether temperature sensors 50, 54 are swapped. The thermal inertia of after-treatment device 18 may delay a rise in the downstream temperature caused by a rise in the upstream temperature. That is, the thermal inertia of after-treatment device 18 may cause the rate of increase of the downstream temperature to be less than the rate of increase of the upstream temperature. As such, for a given operating state, the upstream temperature may reach steady state prior to the downstream temperature. Likewise, after a regeneration event concludes, the thermal inertia of after-treatment device 18 may cause the downstream temperature to cool down more slowly than the upstream temperature.

Controller 32 may thus be configured to detect whether temperature sensors 50, 54 are swapped during or after changes in the operating state of machine 10, engine 14, system 14, and/or other associated systems or components. Abrupt changes in the operating state, in particular, may facilitate detection of swapped temperature sensors 50, 54.

In a first strategy, controller 32 may check for swapped temperature sensors 50, 54 at the onset of a regeneration event or shortly thereafter, and when the measured upstream and downstream temperatures are within a predetermined range (e.g., 200° C.). Alternatively or additionally, controller 32 may be configured to wait a specified period of time to elapse since regeneration was initiated. It is to be appreciated that, at a given point during or shortly after initiation of regeneration, the upstream temperature should be predictably greater than the downstream temperature due to the thermal inertia of after-treatment device 18. In addition, when the upstream and downstream temperatures are relatively cool (e.g., less than 200° C.), and after-treatment device 18 is also thus relatively cool, the thermal inertia of after-treatment device 18 may result in the high exhaust temperatures caused by regeneration to effectuate a rate of downstream temperature increase significantly lower than the rate of upstream temperature increase. In addition, as the temperature of after-treatment device 18 increases, its thermal inertia may decrease (i.e., it may become "easier" to heat up). The predetermined range (or specified amount of time) may thus be chosen to ensure that the upstream and downstream temperatures are cool enough to allow a temperature sensor swap to be comparatively detected upon a sudden increase or decrease in the upstream temperature.

As such, controller 32 may check for a temperature sensor swap when after regeneration device 28 (e.g., burner assembly 30) has been activated and the upstream and downstream temperatures are within the predetermined range (e.g., 200° C.), and/or after the specified amount of time has elapsed since the onset of regeneration. This may ensure the upstream and downstream temperatures are cool enough to expose the swap during the regeneration event. Thus, once either or both of the measured upstream and downstream temperatures have risen by a specified amount (e.g., 100° C.), or after a specified period of time (e.g., 10 seconds) stored in memory, controller 32 may compare the measured upstream and downstream temperatures. Like the predetermined range, it is to be appreciated that the specified period of time may be chosen as to ensure a that temperature sensor 50, 54 swap can be reliably detected, if it is indeed present. These values may be chosen or calculated based on the sensitivity and/or accuracy of temperature sensors 50, 54; the thermal inertia of after-treatment device; the type of fuel used; and/or other factors.

If the difference between the measured upstream and downstream temperatures is above a threshold (e.g., 50° C.), controller 32 may determine that temperature sensors 50, 54 are swapped. One of skill in the art will appreciate that by waiting until either or both of the measured upstream and downstream temperatures have risen by the specified amount or until the specified period of time has elapsed, controller 32 may advantageously utilize the thermal inertia of after-treatment device 18 to detect whether temperature sensors 50, 54 are swapped. Specifically, if the measured downstream temperature has risen, with respect to the measured upstream temperature, beyond what is reasonably expected under the circumstances, controller 32 can determine that temperature sensors 50, 54 are swapped. For instance, controller 32 may determine that temperature sensors 50, 54 are swapped if the following inequality (1) is satisfied:

$$T_{down}-T_{up}>T_{threshold}, \quad (1)$$

where $T_{down}$ is the downstream temperature measured by downstream temperature sensor 54; $T_{up}$ is the upstream temperature measured by upstream temperature sensor 54; and $T_{threshold}$ is a specified threshold stored in memory or computed by controller 32 and known to indicate that temperature sensors 50, 54 are swapped given the circumstances under which $T_{down}$, and $T_{up}$ are measured and compared (e.g., at the particular point during regeneration). It is to be appreciated that the value of $T_{threshold}$ may depend on particular characteristics of machine 10, engine 14, after-treatment device 18, filter medium 14, regeneration device 28; the type of fuel used; the operating temperature ranges of system 16; and/or other relevant conditions or characteristics. $T_{threshold}$ may be computed based on fleet data gathered in the field for a particular type of machine 10, simulation data, and/or any other means known in the art.

In a second strategy, controller 32 may alternatively or additionally be configured to check for a temperature sensor 50, 54 swap upon the completion of a regeneration event, when the upstream and downstream temperatures are substantially equal. It is to be appreciated that the duration of a regeneration event may be sufficient to cause the downstream temperature to eventually be about the same as the upstream temperature. In other words, a complete regeneration event may result in the upstream and downstream temperatures reaching a steady state condition in which the upstream temperature is about equal to the downstream temperature.

Just as the thermal inertia of after-treatment device 18 may cause the downstream temperature to increase at a lower rate than the upstream temperature during regeneration, it may likewise cause the downstream temperature to decrease (i.e., cool) at a lower rate than the upstream temperature. That is, when regeneration concludes and the exhaust returns to normal operating temperatures, the exhaust may cool the upstream temperature may more rapidly than the downstream temperature due to the thermal inertia of after-treatment device 18. Controller 32 may thus be alternatively or additionally configured to detect a temperature sensor 50, 54 swap upon completion of a regeneration event. Specifically, upon completion of a regeneration event, controller 32 may wait until either or both of the measured upstream and downstream temperatures have fallen by a specified amount (e.g., 100° C.), or until a specified amount of time has elapsed since regeneration has completed. If the measured downstream temperature has fallen, with respect to the measured upstream temperature, beyond what is reasonably expected under the circumstances, controller 32 can determine that temperature sensors 50, 54 are swapped. For instance, controller 32 may determine that temperature sensors 50, 54 are swapped if the following inequality (2) is satisfied:

$$T_{down}-T_{up}<T_{threshold}, \quad (2)$$

where $T_{down}$ is the downstream temperature measured by downstream temperature sensor 54; $T_{up}$ is the upstream temperature measured by upstream temperature sensor 54; and $T_{threshold}$ is a specified threshold stored in memory or computed by controller 32 and known to indicate that temperature sensors 50, 54 are swapped given the circumstances under which $T_{down}$ and $T_{up}$ are measured and compared (i.e., at the particular point during cool-down). $T_{threshold}$ may be the same as or different than the threshold discussed above with respect to inequality (1).

Controller 32 may be configured to take one or more precautions if it is determined that temperature sensors 50, 54 are swapped; that is, if inequality (1) or (2) is satisfied, depending on whether the temperature sensor 50, 54 swap check was performed at the onset or completion of regeneration, respectively. For instance, controller 32 may be in communication with a display 70. Display 70 may be positioned at any suitable location on machine 10, e.g., in operator station 11. Display 70 may be any kind of display, including a screen, such as, for example, a cathode ray tube (CRTs), a liquid crystal display (LCDs), a plasma screen, or the like. Display 70 may be configured to display information about operating parameters of system 16. Display 70 may include a warning indicator 72 (e.g., a warning lamp, warning message, LEDs, etc.). Controller 32 may be configured to illuminate warning indicator 72 upon a determination that sensors 50, 54 are swapped. Alternatively or additionally, controller 32 may be configured to sound an audible alert upon such a determination. Controller 32 may also be configured to provide other visual feedback regarding operating parameters of system 16 or machine 10 via display 70, if desired.

In another aspect, controller 32 may be configured to log a fault in response to a determination that temperature sensors 50, 54 are swapped. For instance, controller 32 may store a fault code indicating that temperature sensors 50, 54 are swapped in a machine operation log. The fault code may be used by a technician to diagnose and remedy the problem during maintenance or repair of machine 10. Alternatively or additionally, controller 32 may be configured to terminate a current regeneration event and/or preclude further regeneration events until the swapped temperature condition is remedied (e.g., until a technician repairs and resets the condition).

In yet another aspect, controller 32 may be further configured to remedy the improperly swapped sensor condition by swapping the temperature signal indications received from temperature sensors 50 and 54 via communication lines 74 and 76, respectively. Until the swapped sensor condition is corrected, e.g., by a technician servicing machine 10, controller 32 may use the swapped temperature signal indications in subsequent determinations. For instance, controller 32 may use the swapped temperature signal indications to control regeneration events as discussed above.

It is to be appreciated that controller 32 may be configured to similarly manage other faults detected during operation of machine 10. For instance, controller 32 may be configured to log faults when the downstream exhaust temperature exceeds a predetermined temperature or when the downstream exhaust temperature exceeds the upstream exhaust temperature by more than a predetermined amount. Controller 32 may also be configured to terminate the regeneration process if the number of faults reaches a predetermined value (e.g., when three faults have occurred).

INDUSTRIAL APPLICABILITY

The disclosed particulate trap regeneration temperature control system may be useful to enhance exhaust emissions control for combustion engines. In particular, the disclosed system may be useful to detect situations in which an upstream particulate trap temperature sensor and a downstream particulate trap temperature sensor are swapped due to improper installation. By taking precautions in response to such detected conditions, controlling regeneration events based on improper temperature indications may be avoided. Thus, excessive or insufficient regeneration events; failure of the after-treatment device; decreased fuel efficiency; and/or harmful emissions may be reduced. Operation 80 of the disclosed system 16 will now be explained.

Figure 3:
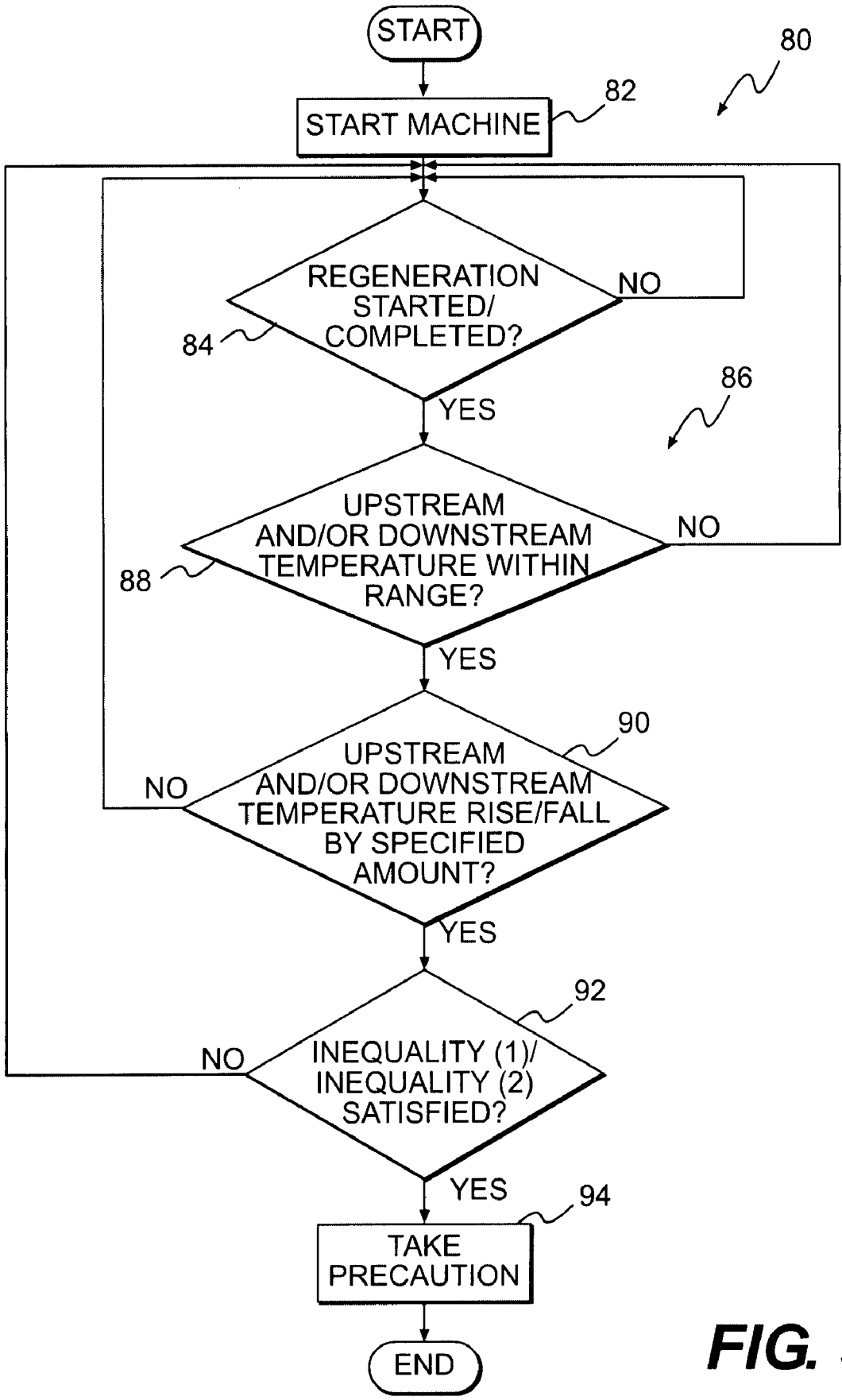
FIG. 3 is a flowchart depicting exemplary operation of the particulate trap regeneration control system of FIG. 2.

Referring to FIG. 3, after machine 10 has been started (step 82), controller 32 may wait until a regeneration event is initiated or completed in accordance with the monitored parameters, as discussed above, depending on whether the first strategy or the second strategy is implemented, respectively (step 84). Immediately after a regeneration event is started—e.g., after burner assembly 30 is engaged or catalyst is introduced and ignited in exhaust flow—or completed, controller 32 may begin to check whether temperature sensors 50, 54 are improperly swapped (step 86).

In particular, controller 32 may read the temperature indication signals provided by upstream temperature sensor 50 and downstream temperature sensor 54 to determine if the upstream and downstream temperatures are within the specified range suitable for initiating checking whether temperature sensors 50, 54 are improperly swapped (step 88). For instance, in implementing the first strategy, controller 32 may determine whether the upstream and downstream temperatures are sufficiently cool to allow a swap to be detected, as discussed above (e.g., less than 200° C.). In implementing the second strategy, controller 32 may determine whether the upstream and downstream temperatures are about equal to ensure that the completed regeneration event heated the upstream and downstream temperatures to a steady state.

If the measured upstream and downstream temperatures are determined to be within range in step 88, controller 32 may wait until the measured upstream and/or downstream temperatures have risen or fallen by the specified amount, depending on whether the first strategy or the second strategy is implemented, respectively (step 90). If the upstream and/or downstream temperatures have risen or fallen by the specified amount, controller 32 may determine whether inequality (1) $T_{down}-T_{up}>T_{threshold}$ or inequality (2) $T_{down}-T_{up}<T_{threshold}$ is satisfied, respectively, as discussed above (step 92).

If controller 32 determines in step 92 that inequality (1) or inequality (2) is satisfied, controller 32 may decide that upstream temperature sensor 50 and downstream temperature sensor 54 are swapped and take a precaution in response thereto (step 94). As discussed above, the precaution may include, for example, logging a fault in a machine operation log; terminating the current regeneration event; disabling future regeneration events; alerting the machine operator (e.g., via display 70); and/or swapping the upstream and downstream temperature indication signals receive by controller 32 via communication lines 74, 76, and controlling and/or monitoring subsequent regeneration events and/or make other temperature determinations using the swapped indications.

By detecting when the upstream particulate trap temperature sensor and the downstream particulate trap temperature sensor have been swapped due to improper installation and taking precautions in response thereto, the disclosed system may prevent malfunctioning of an exhaust after-treatment system. Specifically, the performance and the longevity of the particulate trap may be preserved and excessive or insufficient regeneration events may be avoided. Further, by preemptively detecting and correcting a temperature sensor swap conditions, operating the machine in this undesirable state may be avoided.

It will be apparent to those having ordinary skill in the art that various modifications and variations can be made to the disclosed particulate trap regeneration temperature control system without departing from the scope of the disclosure. Other embodiments will become apparent upon consideration of the specification and practice of the disclosure. For example, step 88 discussed above may be replaced with a step of waiting for or initiating another high machine operating state (e.g., high engine speed) that may cause the upstream and/or downstream temperatures to rise suddenly and allow the measured upstream and downstream temperatures to be compared in view of the thermal inertia of the after-treatment device. It is intended that the specification and examples be considered as exemplary only, with a true scope of the invention being indicated by the following claims and their equivalents.

What is claimed is:

1. An exhaust after-treatment system, comprising:

an exhaust-treatment device positioned in an exhaust flow of an engine;

an upstream temperature sensor disposed to measure a temperature of the exhaust flow upstream of the exhaust-treatment device;

a downstream temperature sensor disposed to measure a temperature of the exhaust flow downstream of the exhaust-treatment device; and a controller receiving from the upstream and downstream temperature sensors indications of the upstream and downstream temperatures, the controller being configured to:

compare the upstream and downstream temperatures;

determine if the upstream and downstream temperature sensors are improperly swapped based on the comparison; and trigger a precaution if it is determined that the upstream and downstream temperature sensors are improperly swapped.

2. The system of claim 1, wherein triggering a precaution includes at least one of logging a fault indicating that the upstream and downstream temperature sensors are improperly swapped, terminating a current exhaust-treatment device regeneration event, and precluding future exhaust-treatment device regeneration events.

3. The system of claim 1, further including a regeneration device disposed with the exhaust-treatment device and configured to reduce buildup of particulate matter within the exhaust-treatment device, wherein:

triggering a precaution includes swapping the indications of the upstream and downstream temperatures, and the controller is in communication with and configured to control the regeneration device based on the swapped upstream and downstream temperature indications.

4. The system of claim 1, wherein the controller is further configured to compare the upstream and downstream temperatures at the onset of or upon the conclusion of a exhaust-treatment device regeneration event.

5. The system of claim 4, wherein the controller is further configured to wait until either or both of the upstream and downstream temperatures have risen or fallen by a specified amount, or to wait a specified amount of time since the onset of or the completion of the exhaust-treatment device regeneration event, before comparing the upstream and downstream temperatures.

6. The system of claim 5, wherein it is determined that the upstream and downstream temperature sensors are improperly swapped if the difference between the downstream temperature and the upstream temperature is above or below a threshold.

7. A method for an exhaust treatment system, comprising:

using an exhaust-treatment device in an exhaust flow of an engine;

receiving from an upstream temperature sensor an indication of a temperature of the exhaust flow upstream of the exhaust-treatment device;

receiving from a downstream temperature sensor an indication of a temperature of the exhaust flow downstream of the exhaust-treatment device;

comparing the upstream and downstream temperatures;

determining, by a controller associated with the exhaust treatment system, if the upstream and downstream temperature sensors are improperly swapped based on the comparison; and triggering a precaution if it is determined that the upstream and downstream temperature sensors are improperly swapped.

8. The method of claim 7, wherein triggering a precaution includes at least one of logging a fault indicating that the upstream and downstream temperature sensors are improperly swapped, terminating a current exhaust-treatment device regeneration event, and precluding future exhaust-treatment device regeneration event.

9. The method of claim 7, wherein triggering a precaution includes:

swapping the indications of the upstream and downstream temperatures, and controlling regeneration of the exhaust-treatment device based on the swapped upstream and downstream temperature indications.

10. The method of claim 7, wherein the comparing is performed at the onset of a exhaust-treatment device regeneration event.

11. The method of claim 10, further including waiting until either or both of the upstream and downstream temperatures have risen by a specified amount, or waiting a specified amount of time since the onset of the exhaust-treatment device regeneration event, before comparing the upstream and downstream temperatures.

12. The method of claim 11, wherein it is determined that the upstream and downstream temperature sensors are improperly swapped if the difference between the downstream temperature and the upstream temperature is above a threshold.

13. The method of claim 7, wherein the comparing is performed upon the conclusion of a exhaust-treatment device regeneration event.

14. The method of claim 13, further including waiting until either or both of the upstream and downstream temperatures have fallen by a specified amount, or waiting a specified amount of time since the completion of the exhaust-treatment device regeneration event, before comparing the upstream and downstream temperatures.

15. The method of claim 14, wherein it is determined that the upstream and downstream temperature sensors are improperly swapped if the difference between the downstream temperature and the upstream temperature is below a threshold.

16. A machine, comprising:

a combustion engine configured to power operations of the machine; and an exhaust after-treatment system, comprising:

an exhaust-treatment device in an exhaust flow of an engine;

an upstream temperature sensor disposed to measure a temperature of the exhaust flow upstream of the exhaust-treatment device;

a downstream temperature sensor disposed to measure a temperature of the exhaust flow downstream of the exhaust-treatment device; and a controller in communication to receive from the upstream and downstream temperature sensors indications of the upstream and downstream temperatures, the controller being configured to:

compare the upstream and downstream temperatures;

determine if the upstream and downstream temperature sensors are improperly swapped based on the comparison; and trigger a precaution if it is determined that the upstream and downstream temperature sensors are improperly swapped.

17. The machine of claim 16, wherein triggering a precaution includes at least one of logging a fault indicating that the upstream and downstream temperature sensors are improperly swapped, terminating a current regeneration event, and precluding future exhaust-treatment device regeneration events.

18. The machine of claim 16, further including a regeneration device disposed with the exhaust-treatment device and configured to reduce buildup of particulate matter within the exhaust-treatment device, wherein:

triggering a precaution includes swapping the indications of the upstream and downstream temperatures, and the controller is in communication with and configured to control the regeneration device based on the swapped upstream and downstream temperature indications.

19. The machine of claim 16, wherein the controller is further configured to compare the upstream and downstream temperatures at the onset of or upon the conclusion of a exhaust-treatment device regeneration event.

20. The machine of claim 19, wherein:

the controller is further configured to wait until either or both of the upstream and downstream temperatures have risen or fallen by a specified amount prior to comparing the upstream and downstream temperatures, and it is determined that the upstream and downstream temperature sensors are improperly swapped if the difference between the measured downstream temperature and the measured upstream temperature is above or below a threshold.

* * * * *